United States Patent [19]

Minnick et al.

[11] 4,447,472

[45] May 8, 1984

[54] MAGNET WIRE COATING METHOD AND ARTICLE

[75] Inventors: Michael G. Minnick; James J. Connell; Charles W. McGregor, all of Fort Wayne, Ind.

[73] Assignee: Essex Group, Inc., Fort Wayne, Ind.

[21] Appl. No.: 421,753

[22] Filed: Sep. 23, 1982

[51] Int. Cl.[3] ..... B05D 5/12

[52] U.S. Cl. ..... 427/120; 428/379; 428/383; 174/110 SR; 174/110 N; 174/110 E; 174/110 V

[58] Field of Search ..... 427/120; 428/379, 383, 428/375; 174/110 SR, 110 PM, 110 N, 110 E, 110 V, 120 SR, 120 C

[56] References Cited

U.S. PATENT DOCUMENTS 4,074,006 2/1978 Boldebuck et al. ..... 427/120

*Primary Examiner*—Michael R. Lusignan
*Assistant Examiner*—K. E. Jaconetty
*Attorney, Agent, or Firm*—Harry J. Gwinnell

[57] ABSTRACT

A method of improving the physical and electrical properties of polymer insulation coated electrical conductors is described. A non-ionic surfactant added to an organic solvent solution of insulation polymer followed by coating the solution on the wire, drying and curing, has been found to produce a coated magnet wire with improved concentricity and smoothness, therefore resulting in improvement in other wire properties as well.

6 Claims, No Drawings

MAGNET WIRE COATING METHOD AND ARTICLE

TECHNICAL FIELD

The field of art to which this invention pertains is insulated electrical conductors, and specifically, polymer insulated magnet wire.

BACKGROUND ART

The use of surfactants in water-based coating compositions to improve substrate wetting and stability of the coating composition is well known in the coating art. These surfactants are very effective in lowering the surface tension of the water. This is not the case, however, for coating formulations which employ organic solvents since such surfactants are virtually ineffective in lowering liquid surface tension and hence, are not expected to enhance substrate wetting.

Accordingly, what is needed in this art is a method of improving the properties of organic solvent based coating compositions.

DISCLOSURE OF INVENTION

A method of improving the physical and electrical properties of polymer insulation coated magnet wire is described. To polymer magnet wire insulation in organic solvent solution is added a non-ionic surfactant. The mixture is then applied to a magnet wire substrate in conventional fashion. Surprisingly, although no change in the surface tension of the enamel solution is detected, once the coating material is applied to a magnet wire substrate, dried and cured, the coated substrate demonstrates improved concentricity and smoothness, therefore resulting in improvement in other wire properties as well.

These and other advantages of the present invention will become more apparent from the following description.

BEST MODE FOR CARRYING OUT THE INVENTION

The surfactants useful according to the present invention are non-ionic. The non-ionic surfactants are preferably polyols, specifically branched polyols, and typically aliphatic diamine branched polyols. The TETRONIC R (BASF Wyandotte) series of polyols has been found to be particularly suitable. These polyols have the formula:

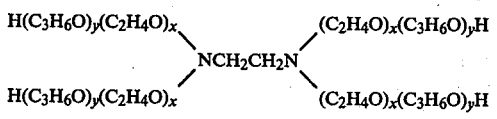

where x and y are so constituted as to result in weight average molecular weights of 2700 to 16,000 with x groups representing 10% to 80% of the total molecular weight. Note U.S. Pat. No. 3,036,118.

The amount of surfactant added will depend on the particular polymer being applied and the particular wire being coated, but generally will be in the range of about 0.01% to about 0.5% by weight of the enamel solution and preferably about 0.03% to about 0.06% by weight. Sufficient surfactant should be present to provide about 0.05% to 0.3% by weight of the final enamel coating, typically 0.09% to 0.18%, and preferably about 0.1% to 0.125%.

The surfactants can be added to the enamel blend at any time, although typically they are added just prior to enamel filtering and application to the wire.

It appears that any polymers containing hydroxyl functionality can be modified and improved according to the present invention. This includes polyesters such as THEIC polyesters (note, e.g., U.S. Pat. No. 3,342,780) and glycerine polyesters (note, e.g., U.S. Pat. No. 2,936,296); polyesterimides (note, e.g., U.S. Pat. No. 4,075,179); polyvinylformals (e.g. Formvar ® polymers, Shawinigan Products Corp., subsidiary of Gulf Oil Co.); polyvinylbutyrals, polyurethanes, epoxies (such as epoxy modified polyurethanes, etc.), etc. When used in a multicoat system, compositions according to the present invention are preferably used as part of the base-coat. And while the polymer compositions according to the present invention can be coated on any electrical conductor, they are preferably used on wires and specifically, magnet wires. The wires are generally copper or aluminum ranging anywhere from about 5 to about 84 mils in diameter, with 40 mils being the most commonly coated wire diameter. The coatings are generally applied anywhere from about 0.2 to about 5.0 mils in thickness and typically about 3.2 mils in thickness in a six-coat pass, with curing between coatings. The coatings can be used as a sole insulation coat or part of a multicoat system in combination with other conventional polymer insulation coatings.

The coatings are generally applied by any conventional means such as coating dies, roller or felt applicators with viscosity adjustments made accordingly. For example, viscosities at 30° C. of about 500 to about 2000 cps are preferred for coating die applications, 100 to 200 cps for roller applications, and 40 to 100 cps for felt applications. Conventional drying ovens are used to dry and cure the coatings at speeds typically of 20 to 1500 feet per minute (6.1 to 457.2 meters per minute), and preferably about 45 to 100 feet per minute (13.7 to 30.5 meters per minute), depending on wire size and coating type. Inlet oven temperatures on the order of about 500° F. to 700° F. (260° C. to 371° C.), preferably about 580° F. (340° C.), and outlet oven temperatures of about 800° F. to about 1000° F. (427° C. to 593° C.), and preferably about 900° F. (482° C.) are used for drying and curing.

The enamel solvents typically used are organic solvents such as cresylic acid, Solvesso ®100 (Exxon Corporation) aromatic hydrocarbons, xylenes, benzene, ethylbenzene, higher substituted benzenes, phenols, N-methyl pyrrolidone, dimethyl formamide, etc., and mixtures thereof. Concentrations anywhere from about 10% to about 70% of polymer in the solvent can be used with about 30%–40% being most typical.

EXAMPLE 1

A THEIC polyester at 30.2% (all percents are percents by weight unless otherwise indicated) solids and 550 cps viscosity at 86° F. (30° C.) in a solvent balance of 70% cresylic acid and 30% Solvesso 100 was coated on 18 AWG copper. Four passes of the polyester were used to obtain 2.4 mils of cured polyester film, over which was added 0.6 mils of polyamide-imide in a two coat construction. The polyester was run with 0.04% non-ionic surfactant TETRONIC 130R2, having the formula:

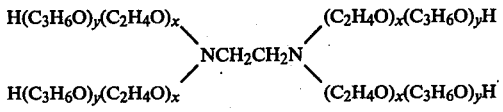

with a weight average molecular weight of y groups of 130 and about 20 weight percent x groups in the compound, and without the surfactant using the same topcoat in both cases. The results are as shown in Table I, A being the sample with surfactant and B without:

TABLE I

| | A | B |
|---|---|---|
| Smoothness | good | acceptable |
| Build | 3.0 mil | 3.0 mil |
| Flexibility snap + x | 2x | 3x |
| Slit Twist Adhesion | 61 | 60 |
| Heat Shock 20% + 3x | 250° C. | 250° C. |
| Emerson Scrape 28# | 2 | 9 |
| Surface Tension of Enamel (dynes/cm$^2$) | 36.8 | 36.9 |

EXAMPLE 2

A THEIC polyester at 40.7% solids and 2800 cps viscosity at 86° F. (30° C.) in a solvent balance of 85% cresylic acid and 15% Solvesso 100 was applied to wire as in Example 1. However, the polyester was applied three ways. Sample 1 had no non-ionic surfactant, Sample 2 had 0.05% non-ionic surfactant, and Sample 3 had 0.10% non-ionic surfactant. The results were as shown in Table II.

TABLE II

| | Sample 1 | Sample 2 | Sample 3 |
|---|---|---|---|
| Smoothness | poor | good | good |
| Build (mils) | 3.0 | 3.1 | 3.0 |
| Flexibility snap + x | 3x | 3x | 3x |
| Slit Twist Adhesion | 73 | 75 | 77 |
| Heat Shock 20% + 3x | 250° C. | 250° C. | 250° C. |
| Emerson Scrape 28# | 10 | 6 | 1 |
| Surface Tension of Enamel (dynes/cm$^2$) | 36.6 | 36.5 | 36.5 |

EXAMPLE 3

A glycerine polyester at 29.5% solids and 255 cps viscosity at 86° F. (30° C.) in organic solvent balance was applied to wire with (0.03% by weight) and without non-ionic surfactant. The results are as shown in Table III, A being the sample with surfactant, and B without:

TABLE III

| | A | B |
|---|---|---|
| Heat Shock 20% + 3x | 200° C. | 200° C. |
| Flexibility | 1x | 1x |
| Build (mils) | 3.3 | 3.3 |
| Smoothness | good | poor |

EXAMPLE 4

A polyesterimide (e.g. as shown in U.S. Pat. No. 4,075,179) at 38.4% solids and 515 cps viscosity at 86° F. (30° C.) in organic solvent balance was applied to wire with (0.07% by weight) and without non-ionic surfactant. The results are as shown in Table IV, A being the sample with surfactant, and B without:

TABLE IV

| | A | B |
|---|---|---|
| Heat Shock 20% + 3x | 180° C. | 180° C. |
| Smoothness | good | poor |
| Build (mils) | 2.1 | 2.1 |
| Flex (snap + x) | 1x | 1x |

EXAMPLES 5–8

Enamels were made of several polymer systems in organic solvent balances. They were applied to wire with (0.02% to 0.05% by weight) and with the non-ionic surfactant. The results are shown in Table V, A with surfactant, and B without.

TABLE V

| Example | % Solids | Viscosity (cps) | Smoothness | |
|---|---|---|---|---|
| 5 - THEIC polyester | 31.0 | 525 | good | acceptable |
| 6 - THEIC polyester | 41.1 | 2800 | good | acceptable |
| 7 - epoxy modified polyurethane | 31.3 | 40 | good | acceptable |
| 8 - Formvar modified polyurethane | 28.5 | 4050 | good | poor |

In the following examples, the concentricity is determined by measuring the coating thickness of a cross-section of coated wire at the thickest point and dividing it by the coating thickness at the thinnest point.

EXAMPLES 9–11

A polyesterimide enamel (as shown in U.S. Pat. No. 4,075,179), a polyurethane enamel and a Formvar enamel were applied to wire in conventional manner with (0.02% to 0.07% by weight) and without the non-ionic surfactant. Cross-sections of the finished wire were made to measure the concentricity of the cured films. The results are shown in Table VI, A with surfactant and B without:

TABLE VI

| Enamel | % Solids | Viscosity (cps) | Wire Smoothness A | Wire Smoothness B | Concentricity A | Concentricity B |
|---|---|---|---|---|---|---|
| Polyesterimide | 38.1 | 1376 | good | acceptable | 1.2:1 | 1.6:1 |
| Polyurethane | 30.2 | 4020 | good | poor | 1.2:1 | 1.7:1 |
| Formvar Enamel | 18.9 | 5000 | good | acceptable | 1.1:1 | 1.5:1 |

As seen from the examples, wire according to the present invention exhibit concentricity less than 2:1, and generally less than 1.5:1. Another indication of the unobviousness of the use of such surfactants in this environment is that the addition of the surfactants to the enamel solution is generally indicated by a foaming which would be expected to result in an enamel with poorer smoothness on wire, however, this is the opposite of what actually happens. What is also surprising is that although there is no change in the surface tension of the enamel, improved wire properties result.

Although not wishing to be bound by an particular theory, it is believed that the hydroxyl functionality of the surfactant allows it to chemically react with the enamel polymers during the cure mechanism on wire by forming ester, urethane or ether linkages, depending upon the enamel polymer system with which it is reacting. This reaction results in a thixotropic effect on the curing enamel and allows it to flow out in a more concentric manner on wire. At the same time, the surfactant which is chemically bound to the polymer changes the surface characteristics of the cured polymer film, allowing succeeding passes of enamel to flow very smoothly over preceeding enamel passes. The resulting coated and cured magnet wire has a more concentric and smoother polymer coating, both of which contribute to maintaining and improving magnet wire properties. This theory is supported by the fact that enamel polymer systems that do not have the ability to react with a hydroxyl functionality, e.g. polyamides, polyamide-imides and polyimides, do not show an improvement in enamel smoothness or concentricity on wire when the same surfactant is added to their enamel formulations. In fact, their smoothness on wire becomes worse indicating that the surfactant has not become chemically bound to the polymers and thus, acts like a high boiling part of the solvent system or thermally decomposes under the enamel application curing conditions.

Another possibility is that the basic nature of the surfactant may enable it to act as a scavenger for trace level contaminates which are acidic in nature. It is known that trace level contaminates which are acidic in nature may cause film surface non-uniformities. The presence of surfactant may impart a buffering capacity and inhibit the formation of film surface non-uniformities. It is also possible that the wettability of the film cured from the enamel is affected when the surfactant is added.

Although this invention has been shown and described with respect to detailed embodiments thereof, it will be understood by those skilled in the art that various changes in form and detail thereof may be made without departing from the spirit and scope of the claimed invention.

We claim:

1. A method of improving the physical and electrical properties of polymeric insulation coated magnet wire comprising preparing a coating composition by mixing about 0.01% to about 5% by weight of non-ionic surfactant having the formula:

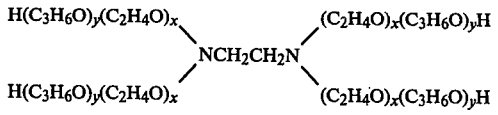

where x and y are so constituted as to result in a weight average molecular weight of 2,700 to 16,000 with x groups representing 10% to 80% of the total molecular weight, with an organic solvent solution of polymer containing hydroxyl functionality, applying said surfactant containing solution to a magnetic wire substrate, and drying and curing the coated substrate to produce a coated magnet wire with improved concentricity and smoothness.

2. The method of claim 1 wherein the non-ionic surfactant is a branched polyol.

3. The method of claim 1 wherein x and y are so constituted as to result in the y groups representing a weight average molecular weight of 130 and x groups constituting about 20% by weight of the surfactant.

4. The method of claim 1 wherein the organic solvent solution of polymer comprises a solution of about 15% to about 50% by weight polyester or polyesterimide in cresylic acid solvent.

5. The method of claim 1 wherein the coated magnet wire has a concentricity less than about 1.5 to 1.

6. The method of claim 1 wherein the organic solvent solution of polymer is selected from the group consisting of polyester, polyesterimide, polyurethane, polyvinylformal, polyvinylbutyral and epoxy polymers.

* * * * *